US006725523B2

(12) United States Patent
Chiang

(10) Patent No.: US 6,725,523 B2
(45) Date of Patent: Apr. 27, 2004

(54) KNOCKDOWN CHAIR

(75) Inventor: Ping-Kuei Chiang, Taipei (TW)

(73) Assignee: Jolly Wood Sdn Bhd, Meleka (MY)

( * ) Notice: Subject to any disclaimer, the term of this patent is extended or adjusted under 35 U.S.C. 154(b) by 0 days.

(21) Appl. No.: 10/075,734

(22) Filed: Feb. 14, 2002

(65) Prior Publication Data

US 2002/0130544 A1 Sep. 19, 2002

(30) Foreign Application Priority Data

Feb. 14, 2001 (MY) ..... PI 2001 0657

(51) Int. Cl.[7] ..... B23P 11/00

(52) U.S. Cl. ..... 29/525.11; 29/453; 29/525.01; 297/440.15; 297/440.16; 297/440.22

(58) Field of Search ..... 297/440.1, 440.14, 297/440.15, 440.16, 440.22; 29/453, 525.01, 525.11

(56) References Cited

U.S. PATENT DOCUMENTS 1,392,242 A * 9/1921 Albergoll ..... 297/445.1 X
3,727,981 A * 4/1973 Ostroff et al. ..... 297/440.15
5,720,457 A * 2/1998 Miller et al. ..... 248/188
5,795,029 A 8/1998 Ma ..... 297/440.16
6,070,941 A 6/2000 Chung ..... 297/440.1

* cited by examiner

*Primary Examiner*—Anthony D. Barfield
(74) *Attorney, Agent, or Firm*—Wiggin & Dana LLP; Gregory S. Rosenblatt

(57) ABSTRACT

A knockdown chair more particularly to one that is easily knocked down to its component parts or as the case may be easily re-assembled into said wooden chair by fixing the components parts together is disclosed. A back rest is permanently fixed to a first seat portion. A second seat portion supports the user. The first and second seat portions are attached together by means of a tongue and groove connection and secured by screws placed advantageously to ensure both seat portions remain intact. Leg assembly members are advantageously detachably fixed to the underside of the attached seat portions. The invention also relates to the method of constructing the chair from the knockdown condition.

1 Claim, 6 Drawing Sheets

KNOCKDOWN CHAIR

CROSS-REFERENCE TO RELATED APPLICATION

This patent application claims priority of Malaysian Patent Application PI 20010657 filed Feb. 14, 2001, the disclosure of which is incorporated by reference in its entirety herein as if set forth at length.

BACKGROUND OF THE INVENTION

1. Field of Invention

The present invention relates to a knockdown wooden chair more particularly to one that is easily knocked down to its component parts or as the case may be easily reassembled into said wooden chair by fixing the components parts together. The invention also relates to the method of constructing the chair from the knockdown condition.

2. Description of the Related Art

Presently, wooden chairs having a seat and a back portion, for example, Windsor chairs come in one piece or several pieces or components parts that are to be joined together.

The single piece chairs, that is, chairs that are completely assembled pose a major storage problem where it occupies a large space when stored or transported. For example when the said chairs are to be exported it would increase the cost of the goods since a lot of space is occupied during shipment. Upon arriving at the port, the goods would again occupy a large space when stored in the go down. Expenses are again increased when the trailers shifting the goods from the go-down to the respective place have to make more trips. Due to the storage problems, the goods price may increase 3 or 4 times more than the actual price. In order to overcome the above storage and transportation problem knockdown chairs were devised and utilized and they are known to consist basically of familiar, expected and obvious structural configurations, notwithstanding the myriad of designs encompassed by the many prior art which have been developed for the fulfillment of countless objectives and requirements.

Known prior art of knockdown wooden chairs include: U.S. Pat. No. 5,795,029—this invention relates to a method of assembling a chair back onto a chair bottom by providing a back portion of material having first and second end portions insertable into the chair bottom, boring a hole longitudinally into the ends of the back members providing a bore transverse to the longitudinal bore on each of the end portions of the chair back, inserting member into the transverse bore, the peg member further including a threaded bore which aligns with the longitudinal bore when the member is positioned therein providing a bolt member insertable into the longitudinal bore from the underside of the chair bottom and threadably engaging the peg member inserted therein and threadably tightening the bolt member so that the bolt member is tightened the chair back end portions are fulled in engagement with the chair bottom.

However the above method of attaching the knockdown chair poses a drawback where the plurality of upright back members between the first and second end portions are not tightly secured where in time they tend to loosen and rotate within the bores. The following document overcomes the above drawback.

U.S. Pat. No. 6,070,941—this invention relates to a knock down chair which comprises a seat, a backrest and a leg assembly. The backrest has a hoop the tapered ends of which are drawn by bolts into spaced apart holes running through the seat. The backrest has spindles or other members running downwardly to a base plate which is removably attached to the top surface of the seat. The base plate is offset toward the rear of the seat from the plane in which the hoop ends lie. The leg assembly is comprised of two opposing leg frames which are screwed to the bottom of the seat. Rungs of the leg frames are joined by a stretcher rail which is held in place by bolts acting similarly to the bolts of the hoop 5 ends.

The above patent has one big disadvantage where it does not provide the flexibility to have different designs for the backrest. FIG. 1 shows several examples of backrest designs that cannot readily be implemented when the method of knock down according to the above patent is used. This is because the said patent uses a base plate to attach the spindles or other members to the seat. Therefore, it would not be possible to secure the design between the hoop of the backrest. Moreover, the use of screws extending from the underside of the seat will secure the base only for a certain period. After a while, especially after the chair is dragged in and out by the user who handles it, the backrest tends to loosen. The present invention is invented in order to solve the above mentioned problems being applicable for most types of wooden chairs.

SUMMARY OF THE INVENTION

Accordingly, it is a primary object of the present invention to provide a knock down chair that can be knocked down to save storage space or easily assembled providing a secured attachment and also having a backrest of various designs that is permanently fixed to the seat. According to the most general aspect of the invention, there is provided a knock down chair comprising: a backrest; a first seat portion wherein the said backrest is permanently fixed to said first seat portion; a second seat portion to support the user; said first and second seat portions are attached together by means of tongue and groove and secured by screw means placed advantageously to ensure both seat portions remain intact; and leg assembly members detachably fixed to the underside of the attached seat portion.

The invention also relates to a method of assembling a knock down chair comprising: joining first seat portion which includes a backrest permanently attached to said first seat portion, to second seat portion wherein the said two portions are attached together by means of tongue and groove; said attached seat portions are secured by at least two screws extending longitudinally from the rear of the first seat portion through the tongued se Lon into the second seat portion; and the leg assembly members are then secured on the underside of the seat by a plurality of screws.

DETAILED DESCRIPTION OF THE INVENTION

Figure 1:
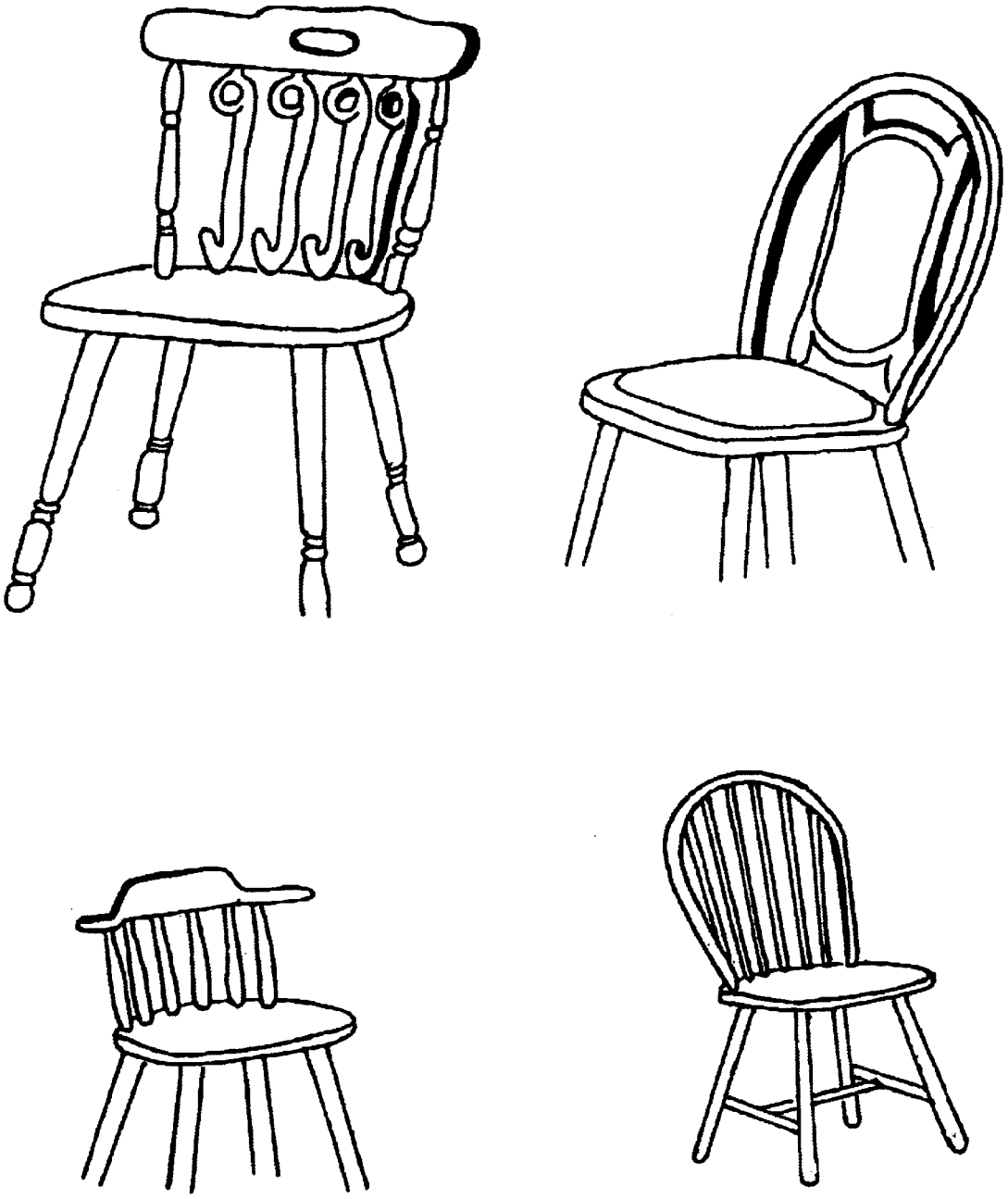
FIG. 1 illustrates a number of different designs of chair backrest.
Figure 2:
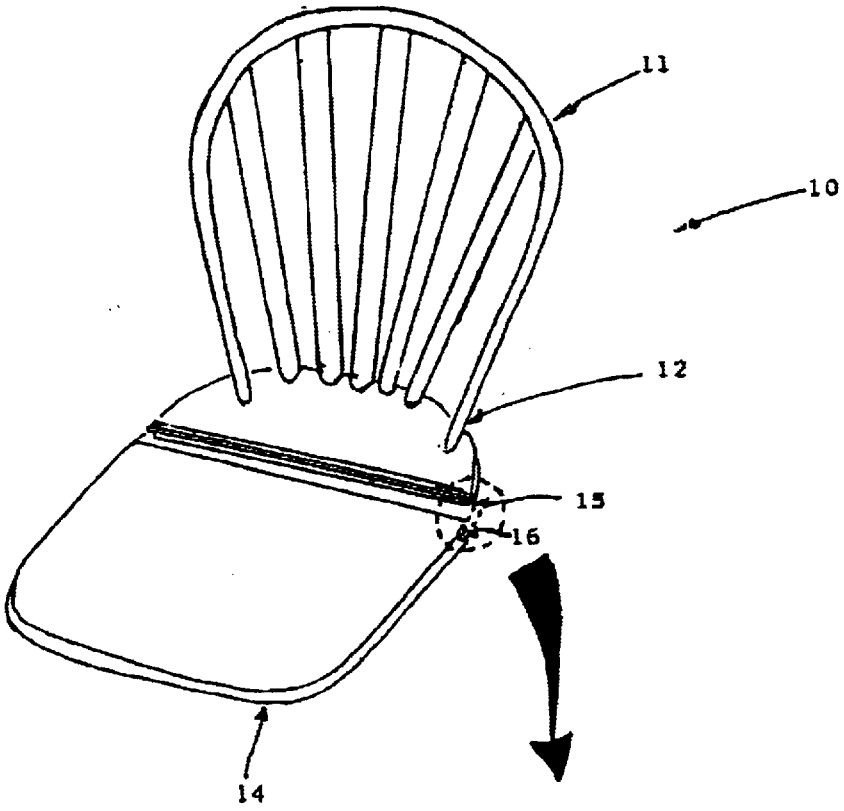
FIGS. 2, 2*a* and 2*b* show the seat of the chair in knock down form and the manner to attach them together.
Figure 2A:
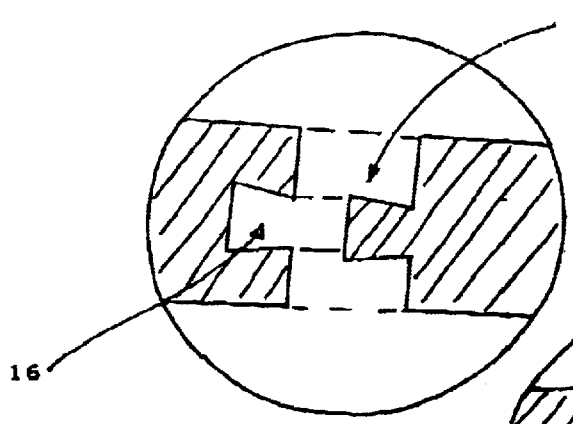
Figure 2B:
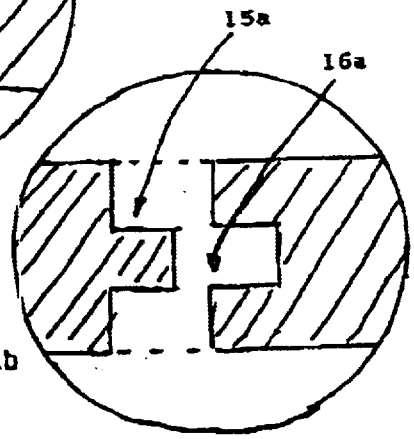
Figure 3:
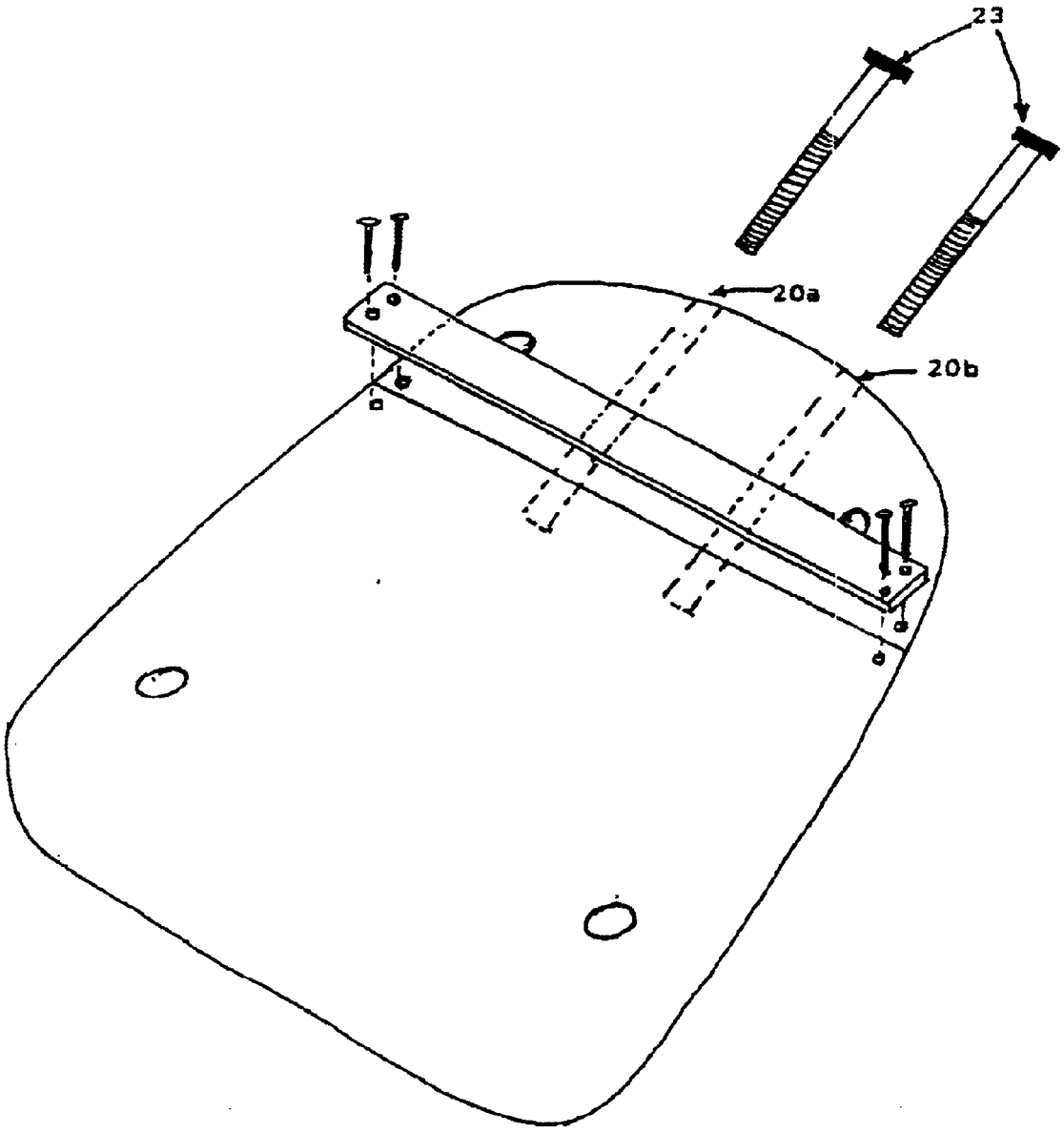
FIG. 3 shows the preferred way of securing the seat where screws extend longitudinally from the back of the first seat portion all the way to the tongued section of the said seat and into the second seat portion. Further securing means is also shown.

FIG. 2 shows a knocked down wooden chair (10) according to the preferred embodiment of the present invention. The seat of the chair is in two portions where the first portion (12) includes the rear section of the seat bottom with the backrest permanently attached to it. The backrest can be of substantially any shape similar to the backrest used in unitary chairs. The front section of the seat bottom that supports most of the user's weight makes up the second portion (14). The coupling assembly for joining together the two seat portions includes the first seat portion having an outwardly projecting tongue (15). The tongue protrudes from the central portion of the first portion and it is only preferred and not essential that the size of the tongue increases at the distal end from the first portion. This can be seen in the exploded view FIG. 2*a*. The assembly further includes a second portion (14) that defines a groove (16). The groove has a configuration corresponding to the tongue The tongue (15) is slid transversely into the groove (16) member to join together the first (12) and second (14) seat portions. However, if the tongue (15*a*) of FIG. 2*b* has a constant thickness then it can be slotted in directly instead of transversely. It should be noted that the tongue may extend from the second portion and the groove formed in the first portion (16*a*).

The first seat portion (12) comprises at least two hollow sections (20*a*, 20*b*) (e.g., bores/channels) extending from the rear end to the front or the tongued section. The second member also has at least two bores (21*a*, 21*b*) extending from the grooved section (16) towards the front of the seat. The bores of both portions are aligned when the portions are joined. This is to enable screws (23) to extend longitudinally along the bores (20*a*&*b*, 21*a*&*b*) to secure the portions together.

Further securing means is provided by adding a piece of, preferably, wood (24) along the underside of the seat spanning the intersection between the two portions (12, 14). The piece of wood (24) is also screwed on to the underside of the seat along both portions. The leg assembly members are then attached to the underside of the seat. Any conventional attachment means may be used (press-fit, glue, screws, etc.). In a four-legged chair, all four legs may be attached to the second seat portion, or two to each portion. Pedestals and other supports are possible.

Figure 4:
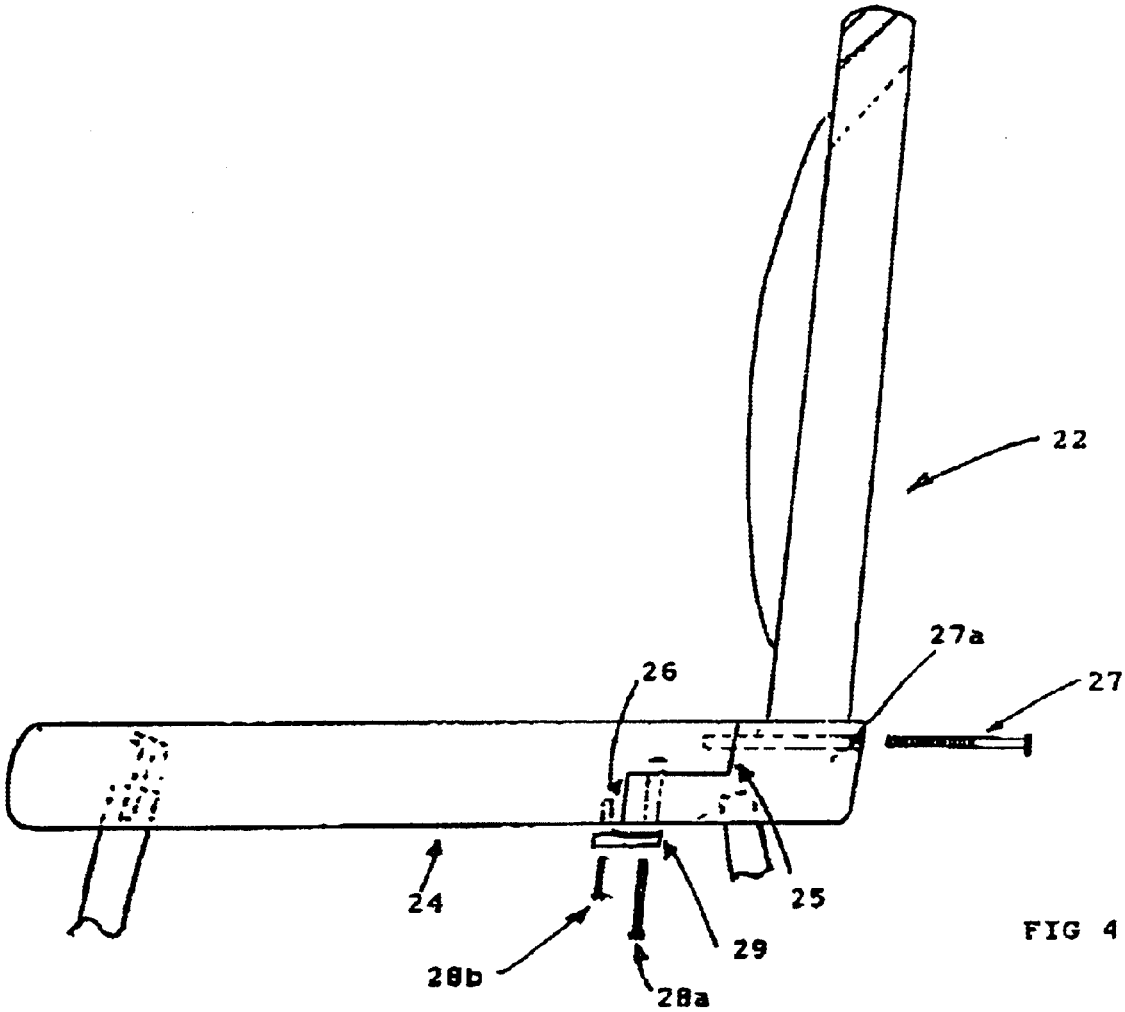
FIG. 4 shows another embodiment of the invention.

According to another embodiment, the seats are joined according to FIG. 4, the first seat portion (22), has a forward protrusion extending in the cross-sectioned shape of an L (25) instead of centrally and the second seat portion has a complementary rearward L (26) shape. The pieces are joined together and secured by at least one screw (27)-extending longitudinally through a bore (27*a*) as shown in the said figure and also by an additional piece (29) attached underside the seat with screws (28*a*, 28*b*) penetrating the appropriate bore as shown.

Figure 5:
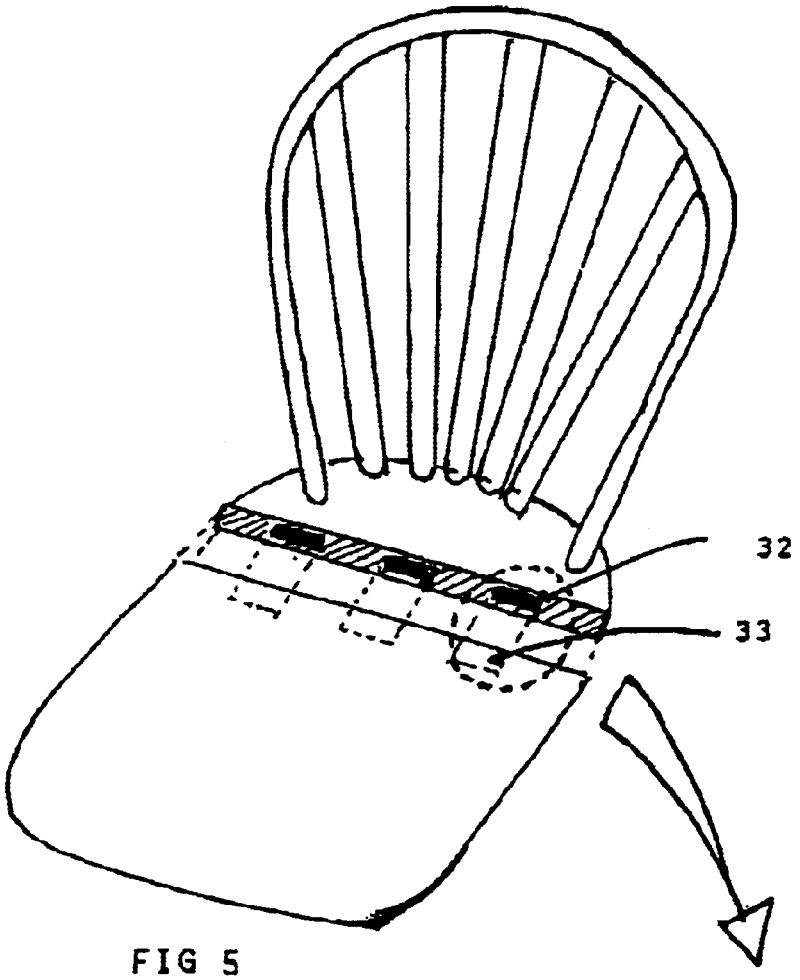
FIG. 5 shows yet another embodiment of the chair in knockdown form and the manner to attach it together.
Figure 5A:
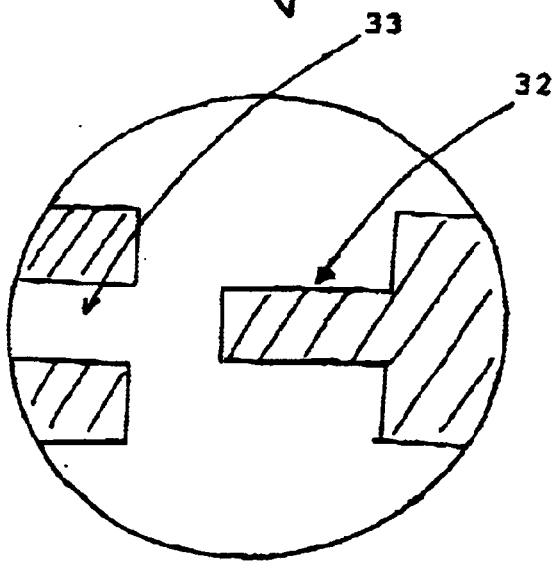
Figure 6:
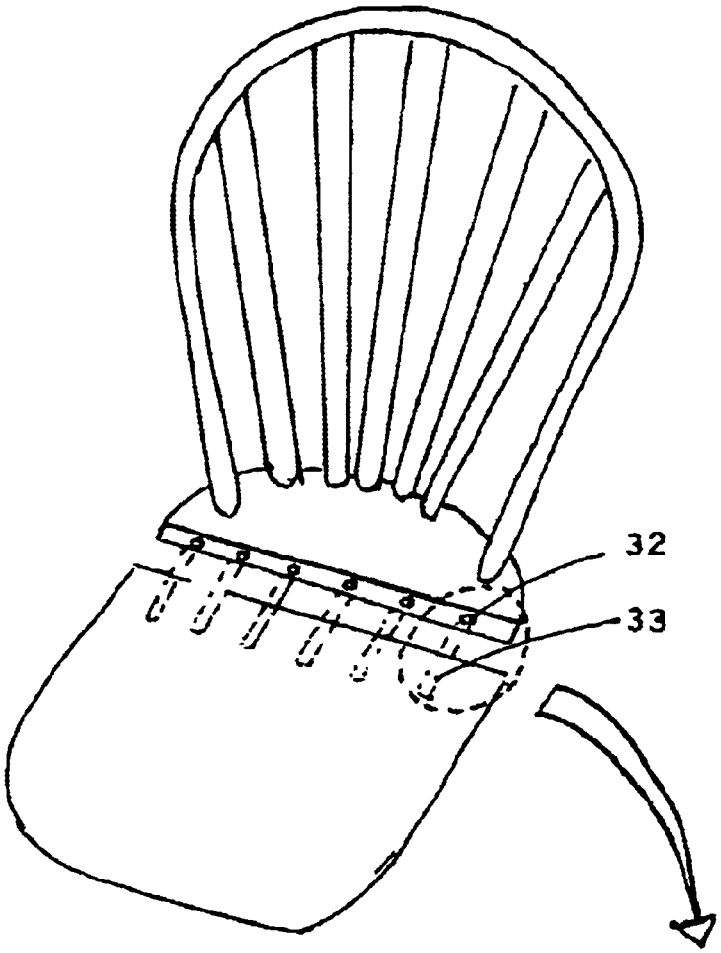
FIG. 6 shows yet another embodiment of the chair in knockdown form and the manner to attach it together.
Figure 6B:
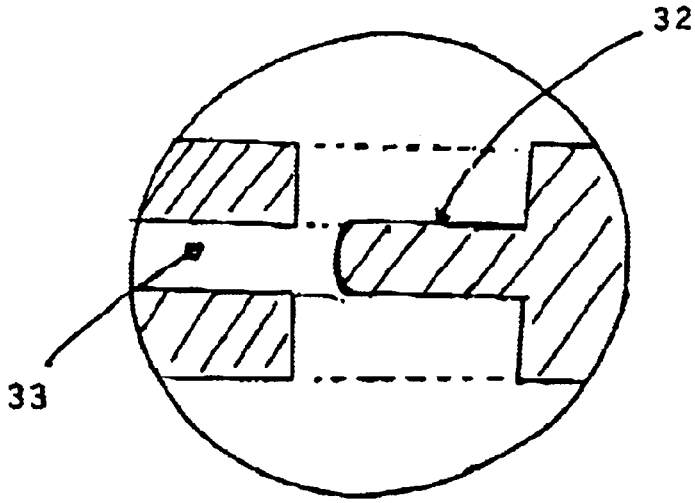

Other embodiments of joining the seats are illustrated in FIGS. 5 and 6. In these figures, as illustrated in exploded views in FIGS. 5*a* and 6*a*, the tongue (32) is in the form of multiple protrusions with an advantageous shape with space therebetween. Accordingly, the groove to receive the protrusions is also in the form of multiple slots (33). It is to be noted that the drawings and description herein are merely to exemplify the invention and do not represent the only and whole range of embodiments of the invention which is capable of many combinations of methods and of the various embodiments' features described herein. Each of the features described may be varied, modified or adapted by a person skilled in the art without departing from the working principle or spirit of the invention which scope is defined in the following claims.

I claim:

1. A method of assembling a knockdown chair comprising:

joining a first seat portion, which includes a backrest permanently attached to said first seat portion, to a second seat portion wherein said first and second seat portions are attached together by means of a tongue and groove connection;

securing said attached first and second seat portions by at least two screws extending longitudinally from a rear side of the first seat portion through the tongue and groove connection into the second seat portion;

securing leg assembly members on an underside of the second seat portion by a plurality of screws; and wherein the tongue of the tongue and groove connection has a distal end thicker than a proximal end and the joining comprises transversely sliding the tongue within the groove to a point wherein at least two screw-receiving channels in the first seat portion are aligned with at least two screw-receiving channels in the second seat portion for receiving said at least two screws upon said securing.

* * * * *